US009726408B2

(12) United States Patent
Yoon et al.

(10) Patent No.: US 9,726,408 B2
(45) Date of Patent: Aug. 8, 2017

(54) AIR CONDITIONER

(71) Applicant: LG Electronics Inc., Seoul (KR)

(72) Inventors: Pilhyun Yoon, Seoul (KR); Yongcheol Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 369 days.

(21) Appl. No.: 14/582,477

(22) Filed: Dec. 24, 2014

(65) Prior Publication Data

US 2015/0184910 A1 Jul. 2, 2015

(30) Foreign Application Priority Data

Dec. 26, 2013 (KR) ..... 10-2013-0163503

(51) Int. Cl.
*F25B 31/00* (2006.01)
*F25B 43/02* (2006.01)

(52) U.S. Cl.
CPC ..... *F25B 43/02* (2013.01); *F25B 31/004* (2013.01); *F25B 2313/0233* (2013.01); *F25B 2500/16* (2013.01); *F25B 2600/2515* (2013.01); *F25B 2700/03* (2013.01)

(58) Field of Classification Search
CPC F25B 43/02; F25B 31/004; F25B 2313/0233; F25B 2500/16; F25B 2600/2515; F25B 13/00; F25B 49/02; F25B 2600/2513; F25B 2313/0253; F25B 2700/03; F25B 2600/027; F04B 39/02; F04B 39/0207; F04C 15/0088; F04C 15/0092; F04C 29/02; F04C 29/021; F04C 2270/24
See application file for complete search history.

(56) References Cited

U.S. PATENT DOCUMENTS 1,000,723 A * 8/1911 Dettmar ..... F25B 41/00 62/125
2,466,863 A * 4/1949 Phillips ..... F25B 5/02 62/472

(Continued)

FOREIGN PATENT DOCUMENTS

CN 11038999 3/2003
CN 1491321 4/2004

(Continued)

OTHER PUBLICATIONS

Chinese Office Action dated Aug. 3, 2016 (English Translation).
European Search Report dated May 28, 2015.

*Primary Examiner* — Jianying Atkisson
*Assistant Examiner* — Miguel A Diaz
(74) *Attorney, Agent, or Firm* — KED & Associates, LLP

(57) ABSTRACT

An air conditioner is provided. The air conditioner may include a compressor to compress a refrigerant, at least one oil sensor disposed in the compressor to detect oil stored in the compressor, an oil separator to separate the oil from the refrigerant discharged from the compressor, a first collection tube to collect the oil separated by the oil separator into the compressor, a second collection tube disposed at a height different from a height of the first collection tube, an oil valve disposed in the second collection tube, and a controller to control the oil valve on the basis of information detected by the oil sensor.

11 Claims, 8 Drawing Sheets

(56) References Cited

U.S. PATENT DOCUMENTS 2,665,557 A * 1/1954 Dodson ..... F25B 43/02 62/193
4,474,034 A * 10/1984 Avery, Jr. ..... F25B 43/003 62/125
5,029,455 A * 7/1991 Backus ..... F25B 43/02 62/470
5,605,058 A * 2/1997 Kurachi ..... F25B 31/004 62/193
5,765,994 A * 6/1998 Barbier ..... F04B 39/0207 250/577
5,875,640 A * 3/1999 Hill ..... F04F 3/00 417/148
5,879,422 A * 3/1999 Brottgårdh ..... B01D 19/0057 55/325
5,911,289 A * 6/1999 Waller ..... F16N 19/006 184/103.2
5,996,372 A * 12/1999 Koda ..... F25B 43/006 62/471
6,122,924 A * 9/2000 Lifson ..... F04B 49/24 62/192
6,125,648 A * 10/2000 Hill ..... F04F 3/00 62/471
7,059,143 B1 * 6/2006 Zugibe ..... F25B 49/02 252/68
8,082,751 B2 * 12/2011 Wiggs ..... F25B 43/006 62/468
9,239,179 B2 * 1/2016 Song ..... F25B 45/00
9,423,165 B2 * 8/2016 Zugibe ..... G06F 17/5068
2002/0078697 A1 * 6/2002 Lifson ..... F25B 31/004 62/84
2003/0068236 A1 * 4/2003 Tadano ..... F01C 21/0809 417/312
2004/0016241 A1 * 1/2004 Street ..... F25B 49/02 62/129
2005/0044864 A1 * 3/2005 Manole ..... F25B 43/006 62/149
2006/0101845 A1 * 5/2006 Jeong ..... F25B 31/004 62/470
2006/0107686 A1 * 5/2006 Jeong ..... F25B 13/00 62/470
2008/0317619 A1 * 12/2008 Chen ..... F04C 18/0215 418/55.2
2010/0126211 A1 * 5/2010 Okamoto ..... F25B 31/004 62/470
2010/0186439 A1 * 7/2010 Ogata ..... F04B 39/0207 62/402
2011/0113797 A1 * 5/2011 Peyaud ..... F25B 49/02 62/115
2011/0239667 A1 * 10/2011 Won ..... F25B 31/004 62/84
2012/0011876 A1 * 1/2012 Sata ..... F04B 39/0038 62/296
2012/0291464 A1 * 11/2012 Yoon ..... F25B 31/004 62/126
2013/0061614 A1 * 3/2013 Jeong ..... F25B 49/02 62/77
2013/0098100 A1 * 4/2013 Bonnefoi ..... F25B 31/002 62/468
2014/0123685 A1 * 5/2014 Kim ..... F25B 13/00 62/56
2014/0130539 A1 * 5/2014 Yoon ..... F25B 31/004 62/470
2014/0165646 A1 * 6/2014 Hellmann ..... F25B 41/00 62/470
2014/0238650 A1 * 8/2014 Yoon ..... F25B 43/006 165/177
2014/0331712 A1 * 11/2014 Kan ..... F25B 43/02 62/470
2015/0114013 A1 * 4/2015 Joo ..... F25B 31/004 62/84
2016/0010885 A1 * 1/2016 Mackey ..... F25B 31/004 137/565.3
2016/0018148 A1 * 1/2016 Yura ..... F25B 13/00 62/192
2016/0201964 A1 * 7/2016 Ochiai ..... F25B 13/00 62/193
2016/0238294 A1 * 8/2016 Hellmann ..... F25B 43/02
2017/0108255 A1 * 4/2017 Fan ..... F25B 31/004

FOREIGN PATENT DOCUMENTS

CN 202648255 1/2013
CN 203132206 8/2013
EP 0 672 875 9/1995
EP 1 367 259 12/2003
EP 1367259 A1 * 12/2003 ..... F04B 39/0207
EP 1 659 351 5/2006
JP EP 1367259 A1 * 12/2003 ..... F04B 39/0207
KR EP 1659351 A2 * 5/2006 ..... F25B 13/00

* cited by examiner

AIR CONDITIONER

CROSS-REFERENCE TO RELATED APPLICATION(S)

The present application claims priority under 35 U.S.C. 119 and 35 U.S.C. 365 to Korean Patent Application No. 10-2013-0163503, filed in Korea on Dec. 26, 2013, which is hereby incorporated by reference in its entirety.

BACKGROUND

1. Field

An air conditioner is disclosed herein.

2. Background

In general, air conditioners are apparatuses that cool/heat an indoor space or purify air using a refrigerant cycle including a compressor, a condenser, an expansion mechanism, and an evaporator so as to promote a more pleasant environment for a user. Air conditioners are classified into air conditioners, in which a single indoor unit or device is connected to a single outdoor unit or device, and multi-type air conditioners, in which a plurality of indoor units or devices is connected to one or more outdoor units or devices to provide an effect as if a plurality of air conditioners are installed.

BRIEF DESCRIPTION OF THE DRAWINGS

Embodiments will be described in detail with reference to the following drawings in which like reference numerals refer to like elements, and wherein.

DETAILED DESCRIPTION

Figure 1:
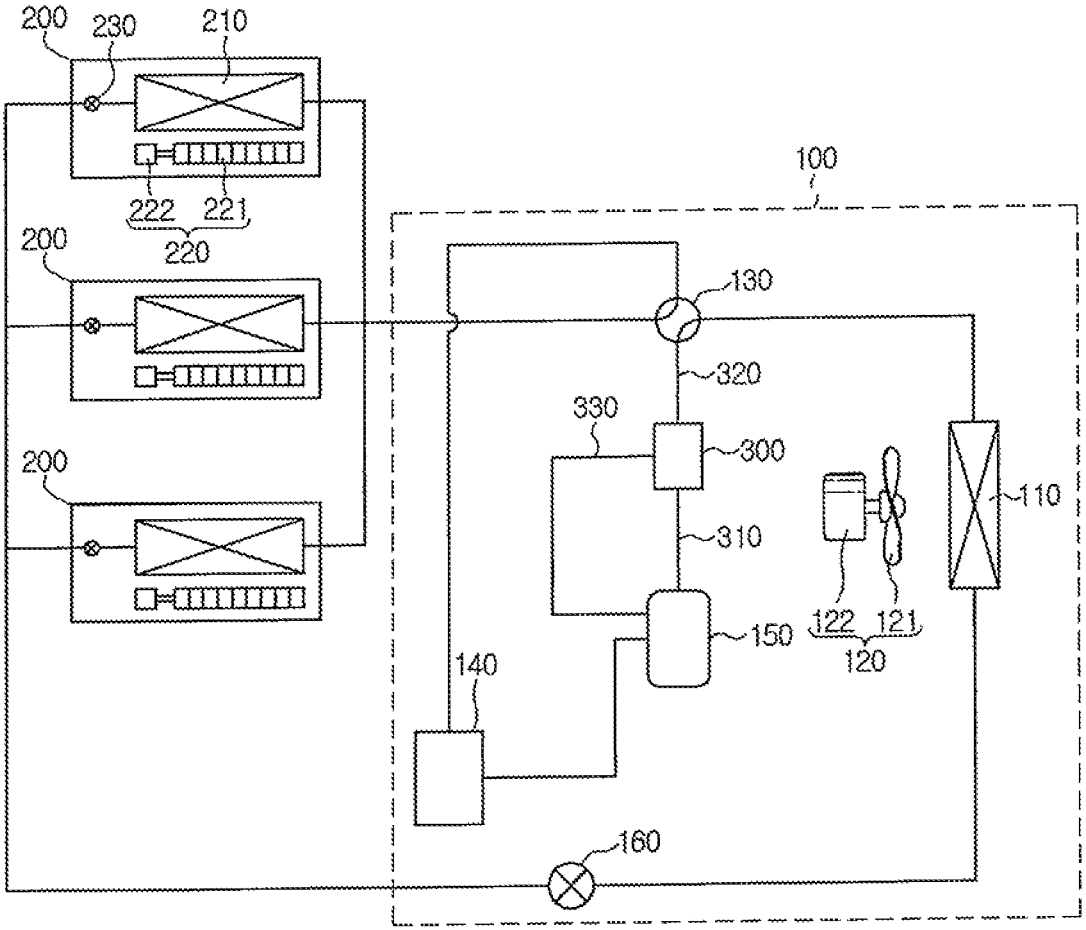
FIG. 1 is a schematic diagram of an air conditioner according to an embodiment.

Reference will now be made in detail to embodiments, examples of which are illustrated in the accompanying drawings. Where possible, like reference numerals have been used to indicate like elements and repetitive disclosure has been omitted.

In the following detailed description of embodiments, reference is made to the accompanying drawings that form a part hereof, and in which is shown by way of illustration specific embodiments which may be practiced. These embodiments are described in sufficient detail to enable those skilled in the art to practice, and it is understood that other embodiments may be utilized and that logical structural, mechanical, electrical, and chemical changes may be made without departing from the spirit or scope. To avoid detail not necessary to enable those skilled in the art to practice, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled" and "joined" to the latter or "connected", "coupled", and "joined" to the latter via another component.

FIG. 1 is a schematic diagram of an air conditioner according to an embodiment. Referring to FIG. 1, an air conditioner according to an embodiment may include one or more indoor unit or device 200 that discharges conditioned air into an inner space, and an outdoor unit or device 100 connected to the one or more indoor device(s) 200.

The outdoor device 100 and the one or more indoor device(s) 200 may be connected to a refrigerant tube to discharge cold or hot air from the one or more indoor device(s) 200 into the indoor space according to a circulation of a refrigerant. Although a plurality of indoor devices 200 are shown connected to the outdoor device 100 in FIG. 1, embodiments are not limited to this number of indoor device 200.

The plurality of indoor devices 200 and the outdoor device 100 may be connected to the refrigerant tube. In addition, the plurality of indoor devices 200 and the outdoor device 100 may be connected to each other through a communicable cable to transmit or receive a control command therebetween according to a predetermined communication manner.

The indoor device 200 may include a discharge hole, through which heat-exchanged air may be discharged. A wind direction adjustment unit or adjuster that opens or closes the discharge hole and controls a direction of the discharged air may be disposed in the discharge hole. Also, the indoor device 200 may adjust an amount of air discharged from the discharge hole.

The indoor device 200 may further include a display unit or display that displays an operation state or set information of the indoor device 200 and an input unit or input to input set data. When a user inputs an operation starting command of the air conditioner through the input, the air conditioner may operate in a cooling mode or a heating mode in respond to the input command.

Hereinafter, inner components of the indoor device 200 and the outdoor device 100 of the air conditioner will be described.

The outdoor device 100 may include an outdoor heat exchanger 110, in which indoor air and the refrigerant may be heat-exchanged with each other, an outdoor blower 120 that blows outdoor air into the outdoor heat exchanger 110, a compressor 150 that compresses the refrigerant, an accumulator 140 that supplies a gaseous refrigerant of a liquid refrigerant and the gaseous refrigerant into the compressor 150, a four-way valve 130 for that converts a flow direction of the refrigerant, and an outdoor electronic expansion valve 160, which may be controlled according to supercooling and superheating degrees when the heating operation is performed.

When the air conditioner performs a cooling operation in the cooling mode, the outdoor heat exchanger 110 may serve as a condenser. On the other hand, when the air conditioner performs a heating operation in the heating mode, the outdoor heat exchanger 110 may serve as an evaporator.

The outdoor blower 120 may include an outdoor fan motor 122 that generates power, and an outdoor fan 121 connected to the outdoor fan motor 122 to be rotated by the power of the outdoor fan motor 122, thereby generating a blowing force.

The indoor device 200 may include an indoor heat exchanger 210, in which indoor air and the refrigerant may be heat-exchanged with each other, an indoor blower 220 that blows the indoor air into the indoor heat exchanger 20, and an indoor electronic expansion valve 230, which may be an indoor flow rate adjustment part or adjuster controlled according to supercooling and superheating degrees.

When the air conditioner performs the cooling operation, the indoor heat exchanger 210 may serve as an evaporator. On the other hand, when the air conditioner performs the heating operation, the indoor heat exchanger 210 may serve as a condenser.

The indoor blower 220 may include an indoor fan motor 222 that generates power, and an indoor fan 221 connected to the indoor fan motor 222 to be rotated by the indoor fan motor 222, thereby generating a blowing force. The air conditioner may function as a cooler to cool the indoor space, or a heat pump to cool or heat the indoor space.

As described above, the air conditioner may include a refrigerant tube, through a refrigerant may flow to perform the cooling or heating operation. When the air conditioner performs the cooling or heating operation, the refrigerant may be circulated into the refrigerant cycle to pass through the refrigerant tube. That is, when the air conditioner operates, the refrigerant compressed by the compressor 150 may be introduced into an oil separator 300 along a suction tube 310 together with oil discharged from the compressor 150. The oil separator 300 may separate the refrigerant and oil introduced therein from each other. The separated refrigerant may be discharged into the discharge tube 320, and the oil separated by the oil separator 300 may flow along an oil collection tube 330. The oil collection tube 330 may be connected to the compressor 150.

If an amount of oil introduced into the compressor 150 is too much or two little, a performance of the compressor 150 may deteriorate. Thus, it may be necessary to adjust an amount of oil collected into the compressor 150 through the oil collection tube 330.

Figure 2:
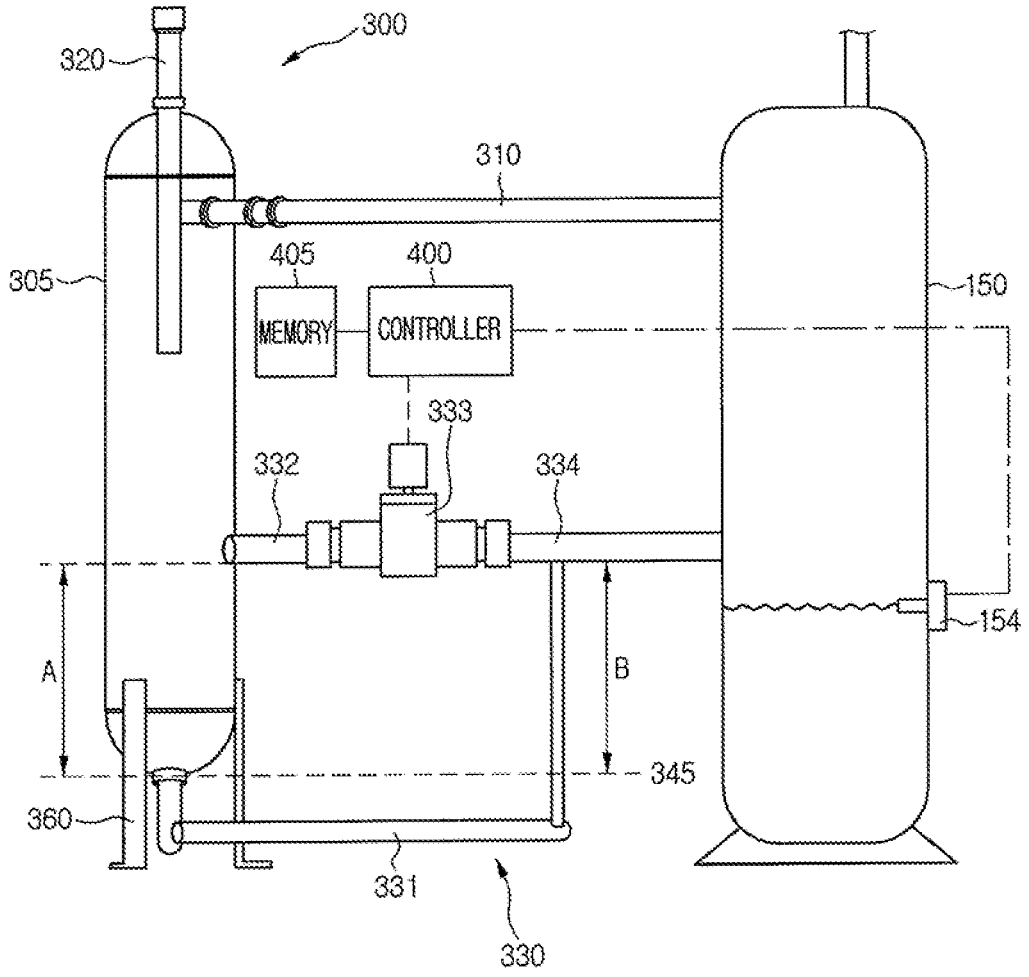
FIG. 2 is a view illustrating a state in which an oil separator and a compressor are connected to each other according to an embodiment.

FIG. 2 is a view illustrating a state in which an oil separator and a compressor are connected to each other according to an embodiment. Referring to FIG. 2, the compressor 150 according to an embodiment may include an oil sensor 154 that detects the oil stored in the compressor 150. The oil sensor 154 may be disposed at a height that corresponds to a level (hereinafter, referred to as a "reference level") of the oil when an adequate amount of oil is stored in the compressor 150.

The oil separator 300 may include a housing 305 that defines an exterior thereof, a suction tube 310 connected to the housing 305 and into which the refrigerant and oil discharged from the compressor 150 may be introduced, a discharge tube 320, through which the refrigerant separated from the oil may be discharged, and an oil collection tube 330, through which the oil introduced through the suction tube 310 may be collected into the compressor 150. The oil separator 300 may further include a support 360 disposed on a bottom surface of the housing 305 to support a load of the housing 305.

The oil collection tube 330 may include a first collection tube 331 disposed in or at the bottom surface of the housing 305 to provide an oil collection path, and a second collection tube 332 disposed in a side surface of the housing 305 to provide an oil collection path. That is, the oil discharged from the compressor 150 into the oil separator 300 may be collected again into the compressor 150 through the first or second collection tube 331 or 332.

The first collection tube 331 may communicate with the second collection tube 332. The first and second collection tubes 331 and 332 may be connected to a convergence part or portion 334. Thus, the oil passing through the first or second collection tube 331 or 332 may be collected into the compressor 150 after being introduced into the convergence portion 334. Alternatively, the second collection tube 332 may connect the oil separator 300 to the compressor 150, and the first collection tube 331 may be connected to the second collection tube 332. A portion at which the second collection tube 332 is connected to the housing 305 may be higher than a position at which the first collection tube 331 is connected to the housing 305.

If the bottom surface of the housing 305 is defined as a reference surface 345, a distance B from the reference surface 345 to the convergence portion 334 may be equal to or less than a distance A from the reference surface 345 to an inlet of the second collection tube 332. This is done to prevent the oil flowing through the second collection tube 332 from flowing backward.

An oil valve 333 may be disposed in the second collection tube 332. For example, the oil valve 333 may be an electronic expansion valve (EEV), an opening degree of which may be adjustable. When the EEV is turned on, an opening degree may be above zero. The opening degree may be variable in the turned-on state of the EEV. On the other hand, when the EEV is turned off, the opening degree may become to zero. The EEV may be adjusted in opening degree from zero to about 100%. In this embodiment, if the opening degree is 100, the EEV may be in a fully opened state.

A controller 400 may be connected to the oil valve 333 and the oil sensor 154 to control an operation, that is, an opening degree of the oil valve 333 on the basis of information detected by the oil sensor 154.

Figure 3:
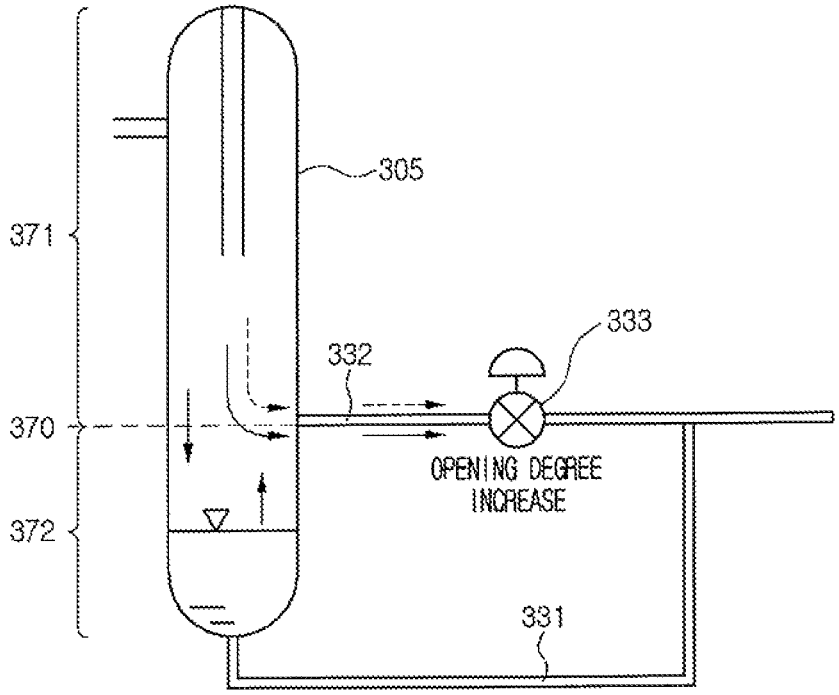
FIGS. 3 to 5 are views illustrating a flow of oil depending on an opening degree of an oil valve according to an embodiment.
Figure 4:
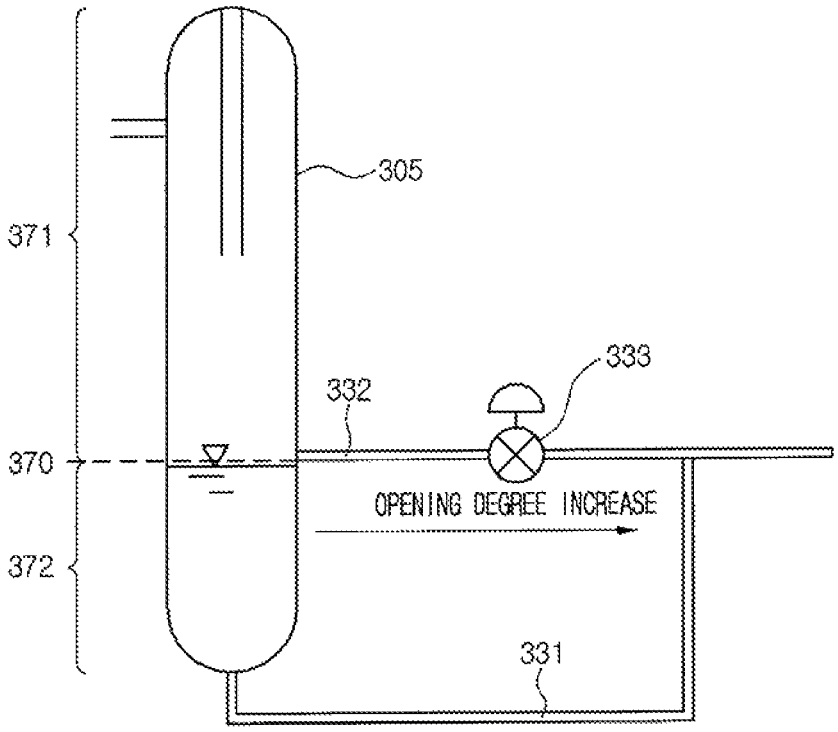
Figure 5:
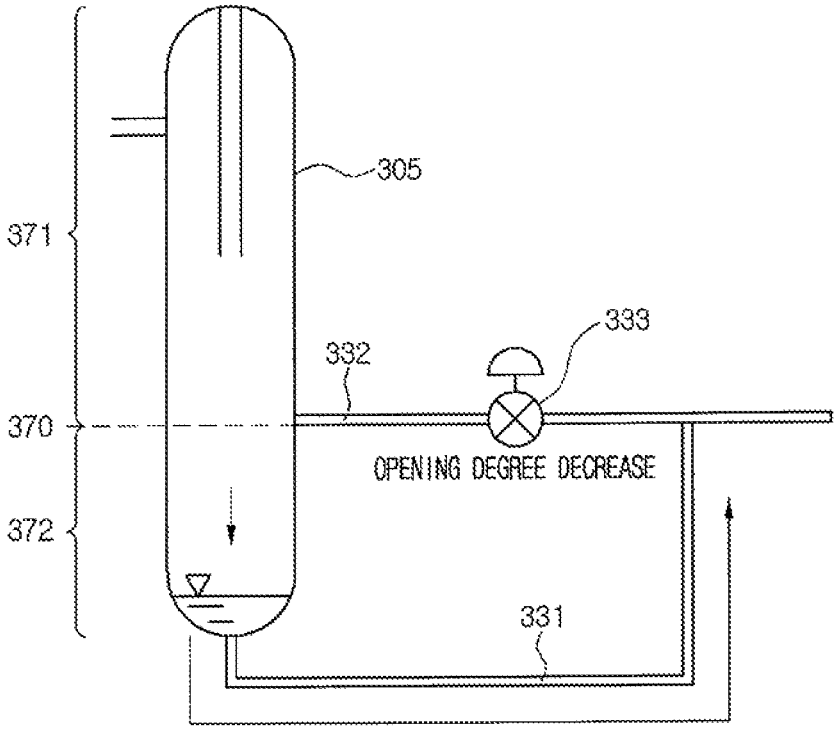
Figure 6:
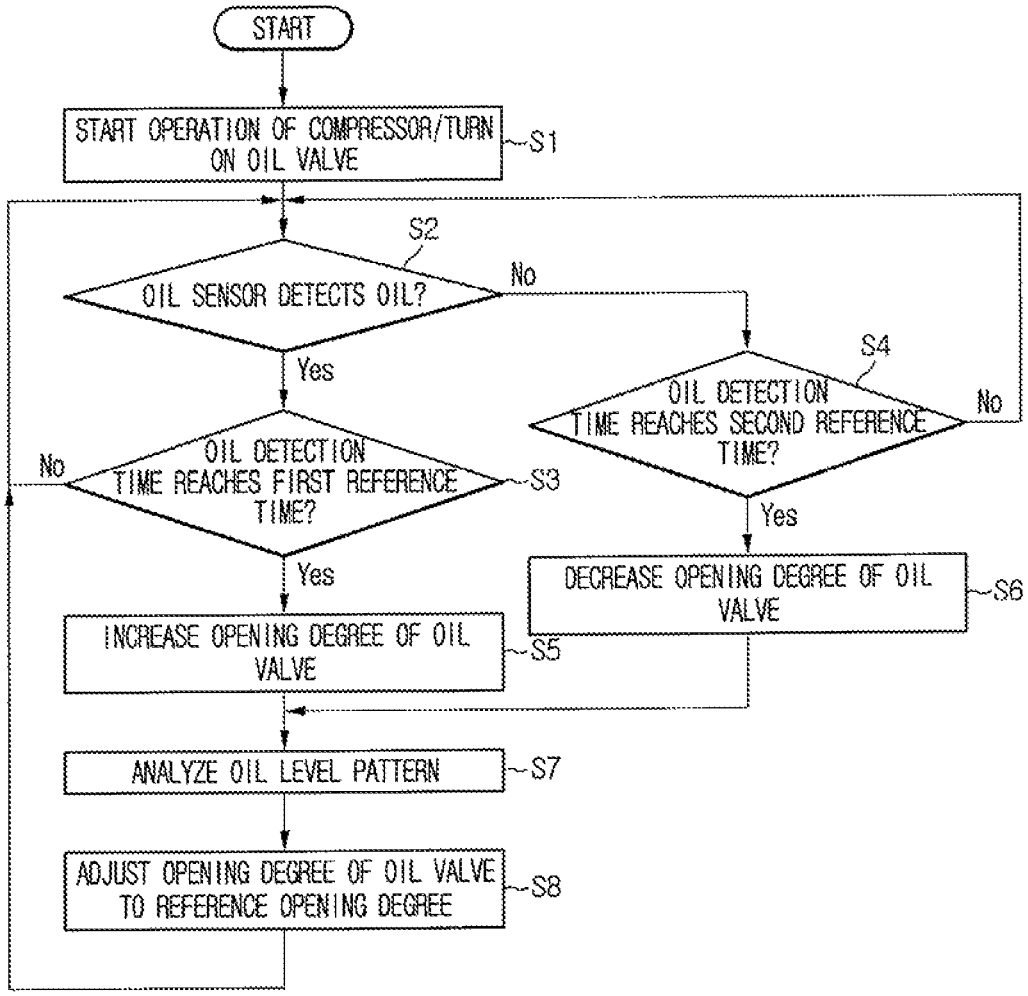
FIG. 6 is a flowchart of a method of controlling an air conditioner according to an embodiment.

FIGS. 3 to 5 are views illustrating a flow of oil depending on an opening degree of an oil valve according to an embodiment. FIG. 6 is a flowchart of a method of controlling the air conditioner according to an embodiment.

Referring to FIGS. 3, 4, and 6, in step S1, when the air conditioner is turned on, and an operation of the compressor 150 starts, the oil valve 333 may be turned on. An opening degree (an initial opening degree) when the oil valve 333 is turned on may be preset or predetermined.

The oil sensor 154 of the compressor 150 may detect oil. In step S2, the controller 400 may determine whether the oil is detected by the oil sensor 154.

If the oil sensor 154 detects the oil in the compressor 150, an oil level may be above a reference level. In the result determined in step S2, if the oil is detected by the oil sensor 154, the controller 400 may determine whether a time at which the oil is detected by the oil sensor 154 reaches or has reached a first reference time, in step S3.

A case in which a time at which the oil sensor 154 detects the oil reaches a predetermined time may be a case in which a time for which the oil is stored at the reference level or more, even though the all together with the refrigerant is discharged from the compressor 150, that is, a case in which the oil stored is at an excessive amount. In this case, it is necessary to reduce the oil level within the compressor 150. In the result determined in step S3, when the time at which the oil is detected by the oil sensor 154 reaches the first reference time, an opening degree of the oil valve 333 may increase from a present opening degree to reduce the oil level within the compressor 150, in step S5.

In this specification, a virtual surface that extends from the second collection tube 332 in a horizontal direction of the housing 305 may be referred to as an extension surface 370. In this case, a portion of the oil separator 300 corresponding to an upper side of the housing 305 with respect to the extension surface 370 may be referred to as an upper portion 371, and a portion of the oil separator 300 corresponding to a lower side of the housing 305 with respect to the extension surface 370 may be referred to as a lower portion.

As illustrated in FIGS. 3 and 4, when the opening degree of the oil valve 333 increases, a pressure difference between both ends of the oil valve 333 may be reduced. Thus, the oil stored in the lower portion 372 of the oil separator 300 may not flow into the first collection tube 331. The oil separated from the oil separator 300 may drop into the lower portion 372 to increase an amount of oil stored in the oil separator 300.

The oil and refrigerant may be mixed with each other in the upper portion 371. A portion of each of the oil (solid line) and refrigerant (dotted line) within the upper portion 371 may be collected through the second collection tube 332. Of course, as the oil is continuously discharged from the compressor 150, the oil level within the compressor 150 may be reduced.

Although the oil is collected into the compressor 150 through the second collection tube 332, as an amount of oil discharged from the compressor 150 is less than an amount of oil collected into the compressor 150, the oil level within the compressor 150 may be reduced. On the other hand, in the result determined in step S2, if the oil is not detected by the oil sensor 154, the controller 400 may determine whether a time at which the oil is not detected by the oil sensor 154 reaches a second reference time, in step S4.

A case in which a time at which the oil is not detected in the compressor 150 exceeds the second reference time may be a case in which the oil is lacking within the compressor 150. Thus, in the result determined in step S4, when the time at which the oil is not detected by the oil sensor 154 reaches the second reference time, an opening degree of the oil valve 333 may decrease from the present opening degree to increase the oil level within the compressor 150, in step S6.

As illustrated in FIG. 5, when the opening degree of the oil valve 333 decreases, a pressure difference between both ends of the oil valve 333 may increase. Thus, the oil stored in the lower portion 372 of the oil separator 300 may flow through the first collection tube 331, and then may be collected into the compressor 150 through the convergence portion 334. As the amount of oil collected into the compressor 150 is greater than the amount of oil discharged from the compressor 150, the oil level within the compressor 150 may increase. As the oil stored in the lower portion 372 is discharged through the first collection tube 331, an amount of oil stored in the lower portion 272 may be reduced.

The controller 400 may analyze an oil level pattern depending on the opening degree of the oil valve 333 on the basis of the oil level detected by the oil sensor 154 of the compressor 150. For example, whether the oil is detected by the oil sensor 154 at a specific opening degree of the oil valve 333 and a time taken until the oil is detected by the oil sensor 154 after the opening degree is adjusted or a time taken until the oil is not detected by the oil sensor 154 may be stored in a memory 405.

The more the opening degree of the oil valve 333 increases, the more the oil level within the compressor 150 decreases at a reduction rate. On the other hand, the more the opening degree of the oil valve 333 decreases, the more the oil level within the compressor 150 increases at an increase rate.

If an increase rate of the oil level increases, the opening degree of the oil valve 333 has to be frequently adjusted. In this case, the oil level may not be maintained at the reference level, but rather, may be significantly changed.

Thus, in this embodiment, the controller 400 may analyze the oil level pattern on the basis of the information stored in the memory 405, in step S7, and also, may set a reference opening degree of the oil valve 333 on the basis of the analyzed result to adjust the opening degree of the oil valve 333, in step S8, so that the adjustment number of opening degree of the oil valve 333 may be minimized.

When the opening degree of the oil valve 333 is initially adjusted after the operation of the air conditioner starts, the reference opening degree may be the initial opening degree. Then, after the opening degree is repeatedly adjusted, the reference opening degree may be an opening degree for which a pattern is analyzed.

For example, when the opening degree of the oil valve 333 increases in order of opening degrees A, B, C, D, and E, the controller 400 may control an opening degree of the oil valve 333 to increase from the present opening degree (it is assumed as the opening degree A) of the oil valve 333 to the opening degree E. In this case, after the opening degree is adjusted, the oil may be detected by the oil sensor 154. A time taken until the oil is not detected by the oil sensor 154 due to the reduction of the oil level may be a time T1.

Next, the controller 400 may control the opening degree of the oil valve 333 to decrease from the opening degree E to the opening degree B so that the oil level within the compressor 150 increases. In this case, after the opening degree is adjusted, the oil may not be detected by the oil sensor 154. A time taken until the oil is not detected by the oil sensor 154 due to the reduction of the oil level may be a time T2.

Next, the controller 400 may control the opening degree of the oil valve 333 to increase from the opening degree B to the opening degree D so that the oil level within the compressor 150 decreases. In this case, after the opening degree is adjusted, the oil may be detected by the oil sensor 154. A time taken until the oil is not detected by the oil sensor 154 due to the reduction of the oil level may be a time T3 greater than the time T1.

Next, the controller 400 may control the opening degree to decrease from the opening degree D to the opening degree C. so that the oil level within the compressor 150 increases. In this case, after the opening degree is adjusted, the oil may not be detected by the oil sensor 154. A time taken until the oil is not detected by the oil sensor 154 due to the reduction of the oil level may be a time T4 greater than the time T2.

As described above, the controller 400 may determine a reference opening degree C. (that is not limited), at which the adjustment number of opening degree decreases, through the adjustment of the opening degree of the oil valve 333. Also, when the oil is detected or not detected by the oil sensor 154 after the oil valve 333 is adjusted in opening degree, the controller 400 may control the opening degree of the oil valve 333 to increase to the reference opening degree C. When the oil valve 333 is opened by the reference opening degree C., the oil may be repeatedly detected or non-detected by the oil sensor 154.

In a state in which the oil is detected by the oil sensor 154, a time having elapsed until the oil is not detected may be less than the first reference time. Also, in a state in which the oil is not detected, a time having elapsed until the oil is detected may be less than the second reference time. In this case, as conditions determined in steps S3 and S4 are not satisfied, the opening degree of the oil valve 333 may be maintained at the present opening degree. Thus, when the opening degree of the oil valve 333 is set to the reference opening degree, the adjustment number of opening degree of the oil valve may be reduced.

Of course, if it is necessary to adjust the opening degree by satisfying the conditions determined in step S3 or S5 even after the opening degree of the oil valve 333 is set to the reference opening degree according to operation conditions of the compressor or operation conditions of the air conditioner. In this case, the controller 400 may adjust the reference opening degree through the analysis of the oil level pattern.

According to this embodiment, as the oil level within the compressor is adjustable through the adjustment of the opening degree of the oil valve on the basis of the oil level detected by the oil sensor, the oil level within the compressor may be stably maintained at a predetermined level. Also, as the opening degree of the oil valve may be adjusted to the reference opening degree through the analysis of the oil level pattern, the adjustment number of opening degree of the oil valve may be minimized.

Figure 7:
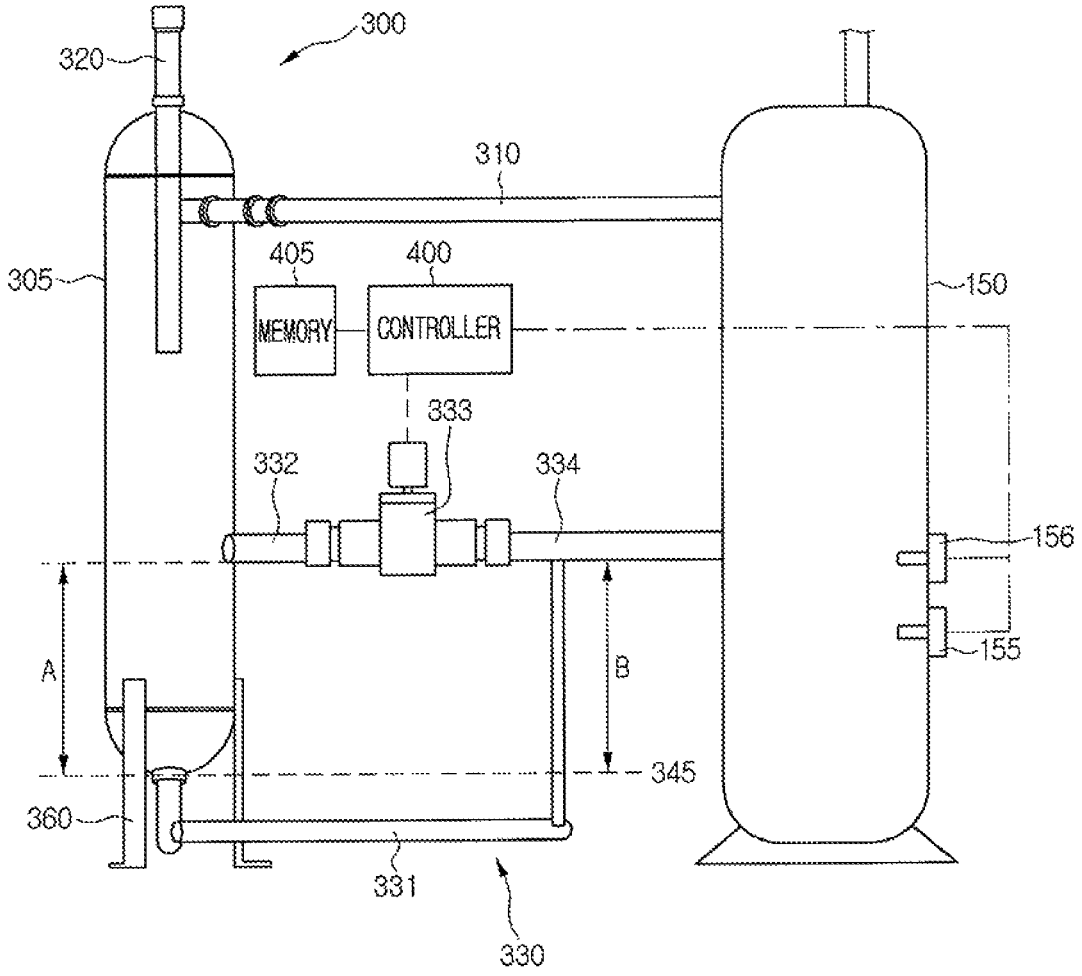
FIG. 7 is a view illustrating a state in which an oil separator and a compressor are connected to each other according to another embodiment.
Figure 8:
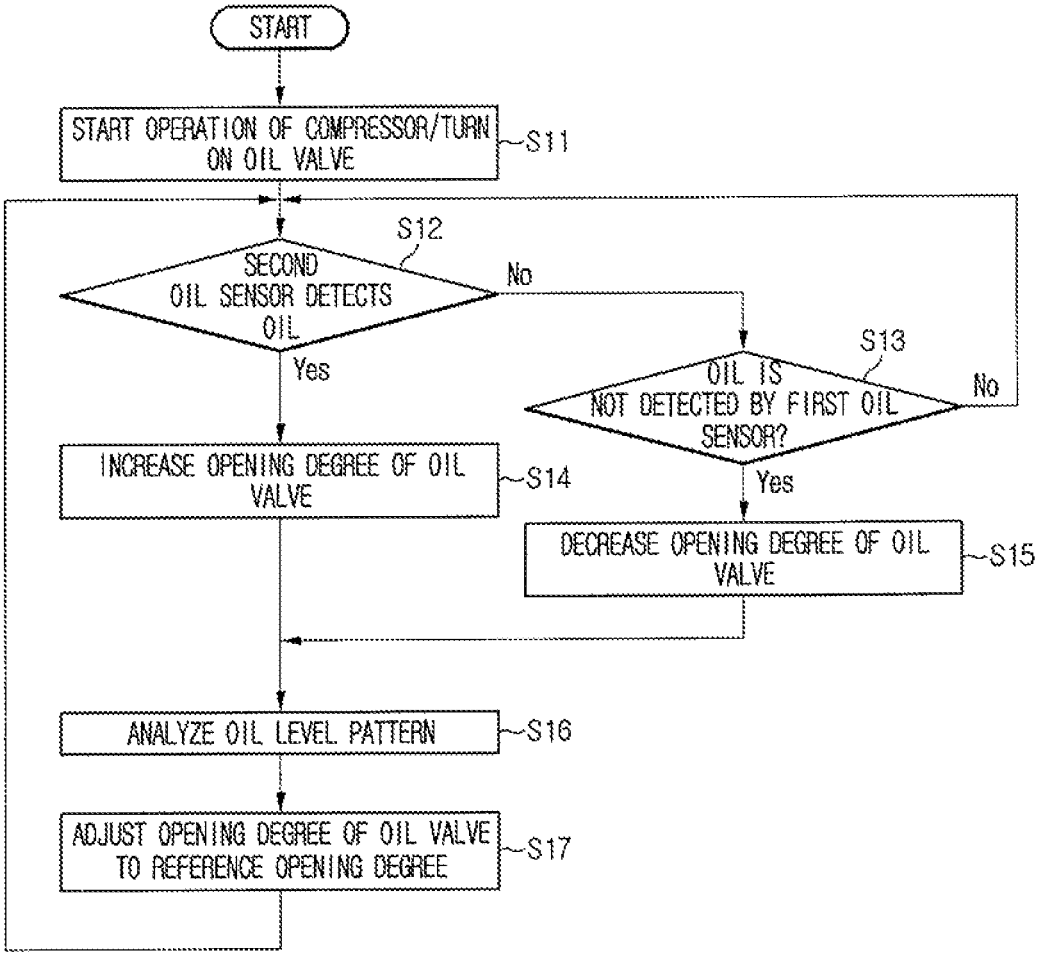
FIG. 8 is a flowchart of a method of controlling an air conditioner according to another embodiment.

FIG. 7 is a view illustrating a state in which an oil separator and a compressor are connected to each other according to another embodiment. FIG. 8 is a flowchart of a method of controlling an air conditioner according to another embodiment.

This embodiment may be the same as the previous embodiment except that the compressor may include a plurality of oil sensors. Thus, only components different from the previous embodiment will be described hereinbelow, and repetitive disclosure has been omitted.

Referring to FIG. 7, compressor 150 according to this embodiment may include a first oil sensor 155 and a second oil sensor 156. The first and second oil sensors 155 and 156 may be disposed at heights different from each other with respect to a bottom surface of the compressor 150, in which oil may be stored. For example, the second oil sensor 156 may be disposed at a height greater than a height of the first oil sensor 155. In this embodiment, a height of each of the oil sensors 155 and 156 may be determined such that a reference level of the compressor 150 may be disposed between the first and second oil sensors 155 and 156.

Referring to FIG. 8, in step S11, when the air conditioner is turned on, and an operation of the compressor 150 starts, an oil valve 333 may be turned on. An opening degree (an initial opening degree) when the oil valve 333 is turned on may be preset or predetermined.

In step S12, controller 400 may determine whether oil is detected by the second oil sensor 156. A case in which the second oil sensor 156 detects the oil in the compressor 150 may be a case in which an amount of the oil stored is excessive. Thus, in the result determined in step S12, when the oil is detected by the second oil sensor 156, the controller 400 may control the opening degree of the oil valve 333 to increase from the present opening degree, in step S14.

On the other hand, in the result determined in step S12, when the oil is not detected by the second oil sensor 156, the controller 400 may determine whether the oil is detected by the first oil sensor 155, in step S13. A case in which the oil is not detected by the first oil sensor 155 may be a case in which an amount of the oil is lacking. In the result determined in step S13, when the oil is not detected by the first oil sensor 155, the controller 400 may control the opening degree of the oil valve 333 to decrease from the present opening degree so that an oil level within the compressor 150 increases, in step S15.

Also, in step S16, the controller 400 may analyze an oil level pattern depending on the opening degree of the oil valve 333 on the basis of the oil level detected by the first and second oil sensors 155 and 156 of the compressor 150. In step S17, the controller 400 may set a reference opening degree of the oil valve 333 on the basis of the analyzed result to adjust the opening degree of the oil valve 333 to the reference opening degree.

Embodiments disclosed herein provide an air conditioner capable of maintaining an oil level within a compressor to or at a predetermined level.

Embodiments disclosed herein provide an air conditioner that may include a compressor to compress a refrigerant; an oil sensor disposed in the compressor to detect oil stored in the compressor; an oil separator to separate the oil from the refrigerant discharged from the compressor; a first collection tube to collect the oil separated by the oil separator into the compressor; a second collection tube disposed at a height different from that of the first collection tube; an oil valve disposed in the second collection tube; and a control unit or controller to control the oil valve on the basis of information detected by the oil sensor.

Embodiments disclosed herein provide an air conditioner that may include a compressor to compress a refrigerant; an oil separator to separate the oil from the refrigerant discharged from the compressor; a first collection tube to collect the oil separated by the oil separator into the compressor; a second collection tube disposed at a position higher than a position of the first collection tube; an oil valve disposed in the second collection tube; and a control unit or controller to control the oil valve. The control unit may decrease an opening degree of the oil valve to increase an oil level within the compressor and increase the opening degree of the oil valve to decrease the oil level within the compressor.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject convergence arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a compressor to compress a refrigerant;

at least one oil sensor provided in the compressor to detect a level of oil stored in the compressor;

an oil separator to separate the oil from the refrigerant discharged from the compressor;

a first collection tube to collect the oil separated by the oil separator into the compressor;

a second collection tube provided at a height different from a height of the first collection tube;

an oil valve provided in the second collection tube; and a controller to control the oil valve based on the level of the oil detected by the at least one oil sensor, wherein the oil valve includes an electronic expansion valve, an opening degree of which is adjustable, wherein the second collection tube connects the oil separator to the compressor, wherein a first side of the first collection tube is connected to the oil separator and a second side is connected to the second collection tube, and wherein a portion of the second collection tube to which the first collection tube is connected is provided higher than the first collection tube.

2. The air conditioner according to claim 1, wherein a portion at which the first collection tube is connected to the second collection tube has a height equal to or less than a height of a portion at which the second collection tube is connected to the oil separator with respect to a bottom surface of the oil separator.

3. An air conditioner, comprising:

a compressor to compress a refrigerant;

at least one oil sensor provided in the compressor to detect a level of oil stored in the compressor;

an oil separator to separate the oil from the refrigerant discharged from the compressor;

a first collection tube to collect the oil separated by the oil separator into the compressor;

a second collection tube provided at a height different from a height of the first collection tube;

an oil valve provided in the second collection tube; and a controller to control the oil valve on the level of the oil detected by the at least one oil sensor, wherein the oil valve includes an electronic expansion valve, an opening degree of which is adjustable, wherein the second collection tube connects the oil separator to the compressor, wherein a first side of the first collection tube is connected to the oil separator and a second side is connected to the second collection tube, and wherein a portion at which the second collection tube is connected to the oil separator is provided higher than a portion at which the first collection tube is connected to the oil separator.

4. An air conditioner, comprising:

a compressor to compress a refrigerant;

at least one oil sensor provided in the compressor to detect a level of oil stored in the compressor;

an oil separator to separate the oil from the refrigerant discharged from the compressor;

a first collection tube to collect the oil separated by the oil separator into the compressor;

a second collection tube provided at a height different from a height of the first collection tube;

an oil valve provided in the second collection tube; and a controller to control the oil valve on the level of the oil detected by the at least one oil sensor, wherein the oil valve includes an electronic expansion valve, an opening degree of which is adjustable, wherein the air conditioner further includes a convergence portion connected to the first and second collection tubes and connected to the compressor, and wherein the convergence portion is provided higher than the first collection tube.

5. The air conditioner according to claim 4, wherein the convergence portion has a height equal to or less than a height of a portion at which the second collection tube is connected to the oil separator with respect to a bottom surface of the oil separator.

6. An air conditioner, comprising:

a compressor to compress a refrigerant;

at least one oil sensor provided in the compressor to detect a level of oil stored in the compressor;

an oil separator to separate the oil from the refrigerant discharged from the compressor;

a first collection tube to collect the oil separated by the oil separator into the compressor;

a second collection tube provided at a height different from a height of the first collection tube;

an oil valve provided in the second collection tube; and a controller to control the oil valve on the level of the oil detected by the at least one oil sensor, wherein the oil valve includes an electronic expansion valve, an opening degree of which is adjustable, wherein, when a time at which the level of the oil detected by the oil sensor is above a reference level reaches a first reference time, the controller increases a present opening degree of the oil valve to reduce a level of the oil stored in the compressor.

7. The air conditioner according to claim 6, wherein, when a time at which the at least one oil sensor does not detect the oil reaches a second reference time, the controller decreases the present opening degree of the oil valve to increase a level of the oil stored in the compressor.

8. The air conditioner according to claim 7, further comprising a memory, in which is stored information regarding whether the at least one oil sensor detects the oil when the opening degree of the oil valve is adjusted to a specific opening degree, and a time taken until the at least one oil sensor detects the oil after the opening degree is adjusted or a time taken until the at least one oil sensor does not detect the oil.

9. The air conditioner according to claim 8, wherein the controller analyzes an oil level pattern within the compressor on the basis of information stored in the memory to set a reference opening degree of the oil valve based on an analyzed result, thereby adjusting the opening of the oil valve to the reference opening degree.

10. An air conditioner, comprising:

a compressor to compress a refrigerant;

at least one oil sensor provided in the compressor to detect a level of oil stored in the compressor;

an oil separator to separate the oil from the refrigerant discharged from the compressor;

a first collection tube to collect the oil separated by the oil separator into the compressor;

a second collection tube provided at a height different from a height of the first collection tube;

an oil valve provided in the second collection tube; and a controller to control the oil valve on the level of the oil detected by the at least one oil sensor, wherein the oil valve includes an electronic expansion valve, an opening degree of which is adjustable, wherein the at least one oil sensor includes a first oil sensor, and a second oil sensor provided at a position higher than a position of the first oil sensor, and wherein the controller decreases a present opening degree of the oil valve when the oil is not detected by the first oil sensor and increases the present opening degree of the oil valve when the oil is detected by the second oil sensor.

11. The air conditioner according to claim 10, further comprising a memory, in which information regarding whether the first oil sensor or the second oil sensor detects the oil when the opening degree of the oil valve is adjusted to a specific opening degree, and a time taken until the first oil sensor or the second oil sensor detects the oil after the opening degree is adjusted or a time taken until the first oil sensor or the second oil sensor does not detect the oil, wherein the controller analyzes an oil level pattern within the compressor on the basis of the information stored in the memory to set a reference opening degree of the oil valve based on an analyzed result, thereby adjusting the opening of the oil valve to the reference opening degree.

* * * * *